US007503269B2

(12) United States Patent
Winslow

(10) Patent No.: US 7,503,269 B2
(45) Date of Patent: Mar. 17, 2009

(54) SYSTEM AND METHOD FOR SUPPORTING A QUILT FOR USE WITH A LONG ARM QUILTING MACHINE

(75) Inventor: Cheryl Winslow, 70 Ridge Rd., West Milford, NJ (US) 07480

(73) Assignee: Cheryl Winslow, West Milford, NJ (US)

( * ) Notice: Subject to any disclaimer, the term of this patent is extended or adjusted under 35 U.S.C. 154(b) by 0 days.

(21) Appl. No.: 11/642,673

(22) Filed: Dec. 21, 2006

(65) Prior Publication Data

US 2007/0193489 A1 Aug. 23, 2007

Related U.S. Application Data

(60) Provisional application No. 60/753,426, filed on Dec. 27, 2005.

(51) Int. Cl.
*D05B 11/00* (2006.01)
*D05B 27/00* (2006.01)

(52) U.S. Cl. ..... 112/117

(58) Field of Classification Search ..... 112/98, 112/99, 100, 117, 118, 470.12, 470.14, 304, 112/307, 475.01, 475.08, 475.17
See application file for complete search history.

(56) References Cited

U.S. PATENT DOCUMENTS

| | | | | |
|---|---|---|---|---|
| 2,501,239 | A | 3/1950 | Schwartz | |
| 3,354,850 | A * | 11/1967 | Story | 112/118 |
| 3,421,464 | A * | 1/1969 | Cash | 112/118 |
| 4,192,241 | A * | 3/1980 | Reed et al. | 112/117 |
| 5,711,236 | A * | 1/1998 | Badger | 112/117 |
| 6,860,211 | B2 * | 3/2005 | Valeriote et al. | 112/117 |
| 6,932,007 | B1 * | 8/2005 | Beauchamp | 112/117 |
| 6,932,008 | B2 * | 8/2005 | Pfeifer | 112/117 |
| 2007/0068432 | A1 | 3/2007 | Ferber et al. | |

* cited by examiner

*Primary Examiner*—Ismael Izaguirre
(74) *Attorney, Agent, or Firm*—Steptoe & Johnson LLP

(57) ABSTRACT

A system for supporting a quilt to lay quilting lines is provided. A frame is configured to support a sewing machine. First and second are rollers mounted on said frame, and configured to hold quilting layers on a substantially horizontal path between said first and second rollers. A platform is mounted on said frame, the platform having tracks, a top of the platform being below said substantially horizontal path. A moveable support table is mounted on the tracks. A top of the moveable support table is less than approximately one inch below said substantially horizontal path. The moveable support table supports a quilt during the application of quilting lines thereto.

15 Claims, 6 Drawing Sheets

SYSTEM AND METHOD FOR SUPPORTING A QUILT FOR USE WITH A LONG ARM QUILTING MACHINE

CROSS REFERENCE TO RELATED APPLICATIONS

The present application claims priority under 35 U.S.C. § 120 to 60/753,426, filed on Dec. 27, 2005, the disclosure of which is expressly incorporated by reference herein in its entirety.

BACKGROUND OF THE INVENTION

1. Field of the Invention

The present invention relates to the manufacture of quilts. More specifically, the present invention relates to a moveable platform mounted on a quilting frame to support the quilt during pouncing.

2. Discussion of Background Information

A quilt is typically made of three layers. The top layer is a piecework or applique, typically of an artistic design. The middle layer is layer of stuffing known as "batting", and is used for warmth. Batting is most commonly cotton, but can be polyester, wool or silk. The bottom layer is one large layer of fabric. Quilting adds depth and a secondary design to the quilt top.

Over the years, a market developed for hand-made quilts, but stitching together the three layers by hand requires inordinate amounts of time. The increase in popularity of the quilting industry created a demand for quicker options for finishing quilts. The longarm quilting machine, long a staple of the industrial workshop, began to appear in homes.

A longarm quilting machine, such as manufactured by Al, is a large throated rolling sewing machine that sits on a large quilting frame that accommodates a full quilt. The frame has a roller system for loading the three layers of a quilt. Manufacturers of longarm quilting machines and quilting frames include GAMMILL, APQS (American Professional Quilting Systems), NOLTING and PRODIGY.

FIGS. 1 and 2 show a typical quilting frame 100. The various layers of material are fed from beneath a support surface 102 to a roller 104, typically called a "belly bar," which is a stationary pole. Tension from torquing the individual materials around roller 104 brings the various layers together. The multi-layer quilt 120 is then fed to another roller 106, which typically has a crank to wind up the multi-layer quilt 120 and keep it taught between rollers 104 and 106. Referring now also to FIG. 3, several grooves 108 extend laterally along support platform 102. The grooves may be embedded in platform 102, or defined by rails lying on top of platform 102. A long arm sewing machine 300 is mounted on a carriage 304 with wheels 302 spaced apart the same distance as grooves 108, and are shaped to engage whatever shape groove 108 is. This allows longarm sewing machine 300 to be mounted on the platform 102 with a limited range of movement along the defined path of the grooves 108. Additional wheels at the base of long arm sewing machine allow lateral movement (left to right in FIG. 3) on carriage 304.

Roller 106 is moveable between a lower position (FIG. 1) and an upper position (FIG. 5). When in the lower position, the quilt lies is substantially horizontal plane (subject to some potential mechanical offset and/or deformation in the quilt under its own weight near the center of rollers 104 and 106). The quilt thus hangs like a taught hammock above the support surface 102. When horizontal, the quilt lies several inches—typically 6-8 inches—above support platform 102 to provide clearance for the base of longarm quilting machine 300. In a typical GAMMILL frame, the quilt is approximately 7 inches above the table, although the exact height varies from manufacturer to manufacturer. The gap is necessary to allow the base of long arm sewing machine 300 with carriage 304 to reach under quilt 120.

Before the pattern can be stitched into quilt 120 with long arm sewing machine 300, the pattern must be laid out with quilting lines. A common method for marking quilting lines is called "pouncing." Three items are used for this technique; a stencil, pounce pad, and chalk. Stencils are MYLAR sheets with small dashed lines cut out to form intricate designs. A pounce pad is a container that allows the chalk to flow out through the weave of fabric. While the quilt 120 is suspended between rollers 104 and 106, the stencil is placed on the quilt top, and the chalk loaded pounce pad is rubbed over the stencil to form quilting lines. The lines define a quilting motif to follow with the sewing machine.

It is difficult to make distinct lines with chalk using the pouncing method. The resulting chalk lines need to stay in place long enough to stitch the desired design. Yet the chalk will bounce when long arm sewing machine 300 is used on the quilt 120, causing the quilting lines to become progressively unclear. If the chalk lines fade before the quilting motif is finished, the quilter will have to "eyeball" the pattern. Any imprecision in the eyeballing will skew the overall design of the final product, reducing its quality and value.

SUMMARY OF THE INVENTION

The present invention is directed to a system for stabilizing quilts during the application of quilting lines.

According to an embodiment of the invention, a system for supporting a quilt to lay quilting lines is provided. A frame is configured to support a sewing machine. First and second are rollers mounted on said frame, and configured to hold quilting layers on a substantially horizontal path between said first and second rollers. A platform is mounted on said frame, the platform having tracks, a top of the platform being below said substantially horizontal path. A moveable support table is mounted on the tracks. A top of the moveable support table is less than approximately one inch below said substantially horizontal path. The moveable support table supports a quilt during the application of quilting lines thereto.

The above embodiment may have various optional features. A forward end of the moveable table support may extend to within one inch of the first roller. The moveable support table may comprise a top surface, a frame beneath the top surface, and a plurality of wheels connected to the frame and mounted in the tracks. The tracks may have a substantially inverted "V" shaped projection, and the plurality of wheels may have a substantially inverted "U" shaped recess. The plurality of wheels define an area, and the area may be offset from a center of the top. a hand grip may extend from the moveable platform. The plurality of wheels may be enclosed by the frame or outside of the frame. The top of the moveable support table may be approximately 1 inch below the substantially horizontal path. The top of the moveable support table may be at least approximately ½ inch below the substantially horizontal path. The plurality of wheels may only allow said table to move at an angle to a longitudinal axis of the top.

According to another embodiment of the invention, A moveable support table configured to for use with a longarm quilting machine, the quilting machine including a frame, members configured to define a horizontal path, a platform having spaced apart tracks below the substantially horizontal path, is provided. The moveable support table includes a top surface, a frame connected to and beneath the top surface, and a plurality of wheels connected to the frame. The wheels being distributed into a plurality of rows spaced apart a distance that corresponds to a distance of the spaced apart tracks. The wheels define an area, the area being offset from a center of the top. When the plurality of wheels are mounted in the tracks, a top of the moveable support table is less than approximately one inch below the substantially horizontal path.

The above embodiment may have various optional features. The plurality of wheels may have a substantially inverted "U" shaped recess. A hand grip may extend from the moveable support table. The plurality of wheels may be enclosed by the frame or outside of the frame. The plurality of wheels may only allow said table to move at an angle to a longitudinal axis of the top.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE EXEMPLARY EMBODIMENT

Figure 1:
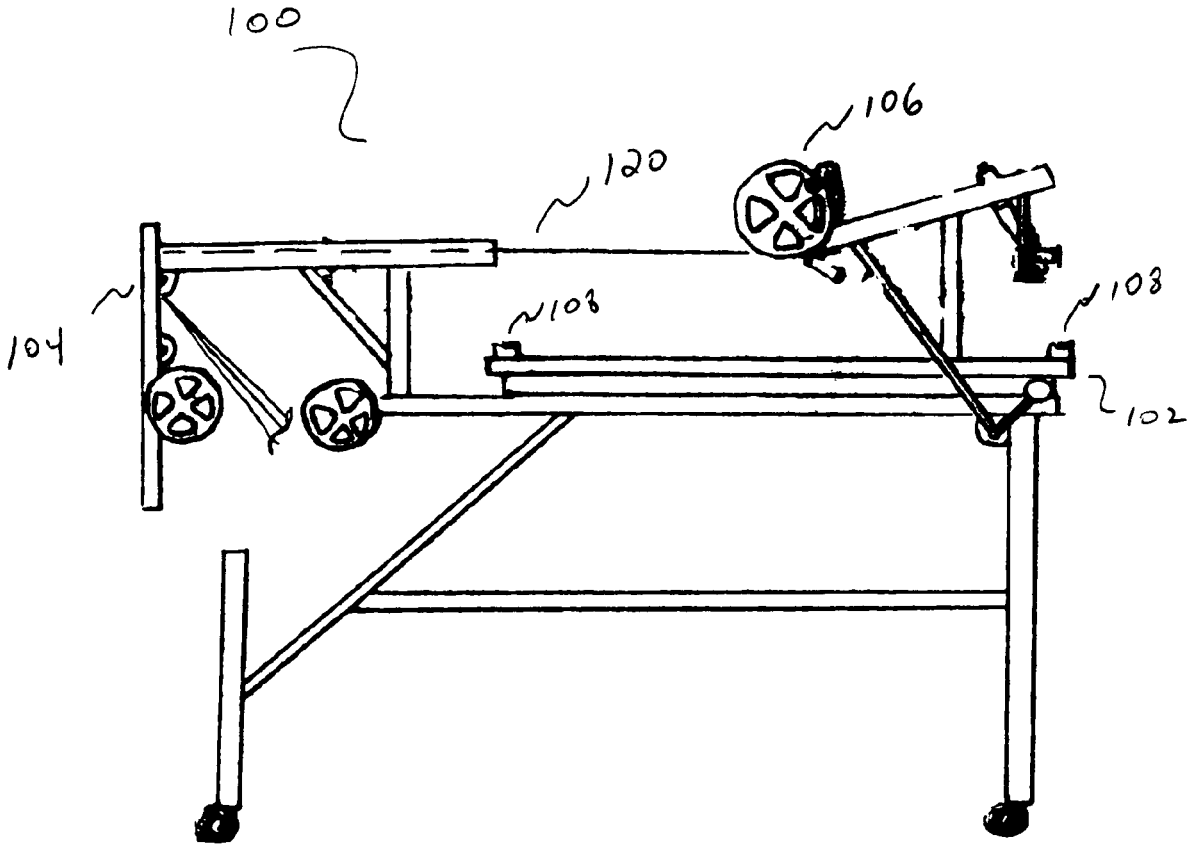
Fig. 1 Prior Art
FIG. 1 is a side view of a quilt frame.
Figure 2:
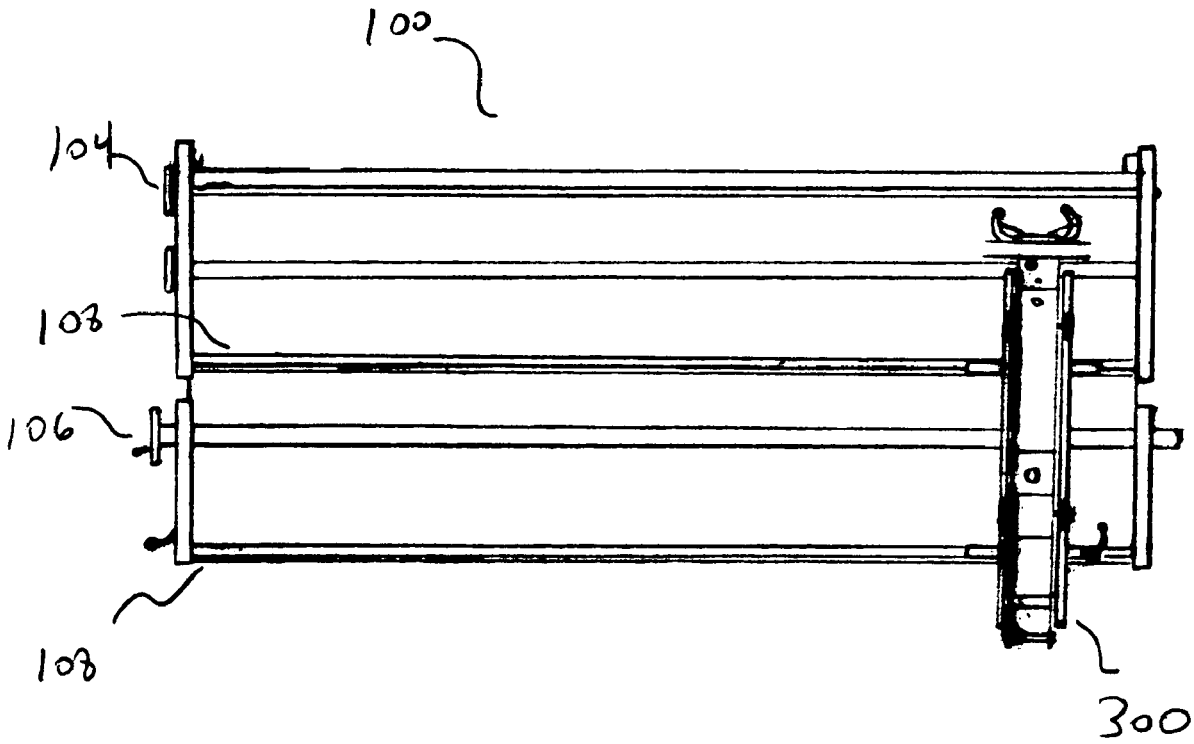
Fig. 2 Prior Art
FIG. 2 is a top view of quit frame with a longarm sewing machine mounted thereon.
Figure 3:
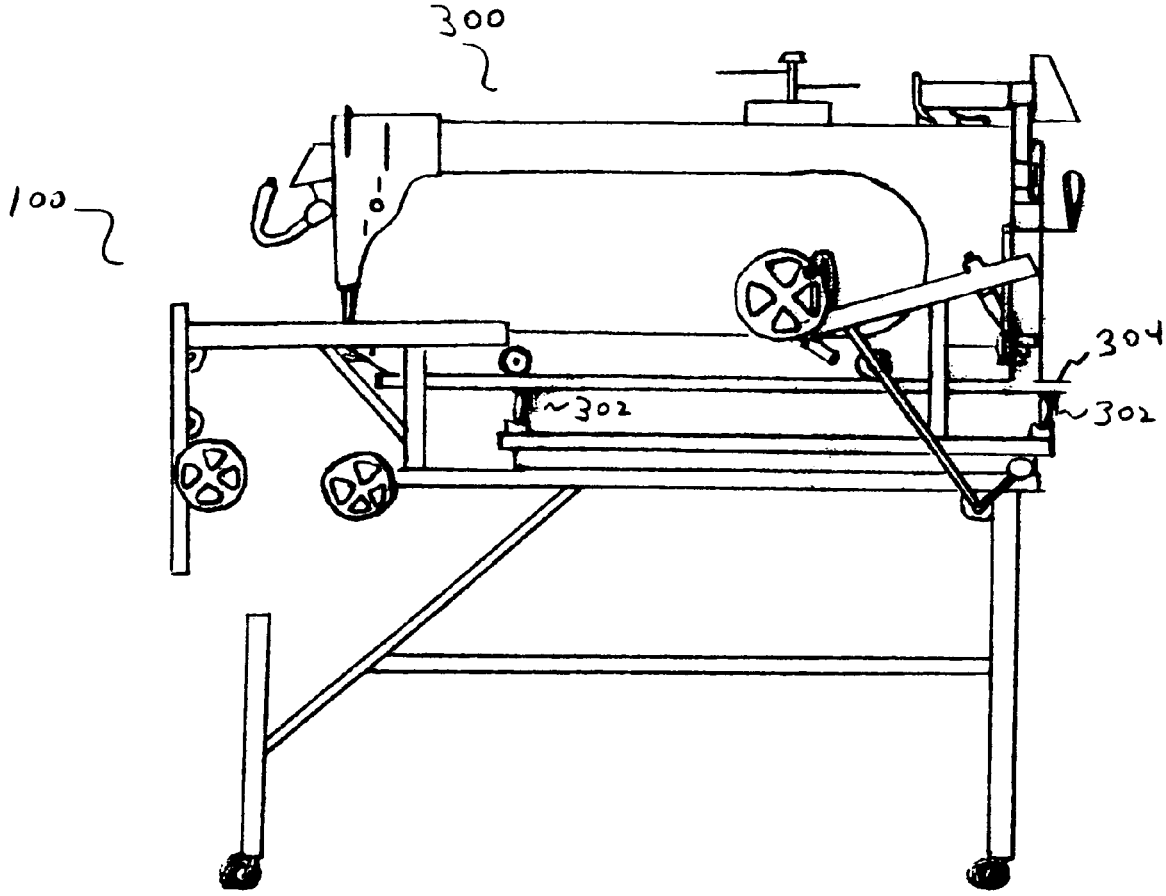
Fig. 3 Prior Art
FIG. 3 is a side view of a quit frame with a longarm sewing machine mounted thereon.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

An embodiment of a stencil table 400 for use with the present invention is shown in FIGS. 4A-4C. It includes a top 404, an intermediate supporting box frame 406, and a bottom with a plurality of wheels 402. Top 404 and frame 406 are preferably made from wood ¾ inches thick. Of course, other materials and thicknesses could be used provided it was strong enough to provide support but light enough to be easily moved.

The lateral distance between the wheels 402 and the shape of wheels 402 are determined by the nature of the grooves 108 in the corresponding quilting frame 100. That is, wheels 402 will have a shape designed to engage with the specific grooves 108, and will be spaced apart substantially the same distance as the grooves 108. FIG. 4A shows a total of 4 wheels, but any number may be used. Wheels 402 could also be replaced with other know types of sliding/rolling engagement structures.

Figure 5:
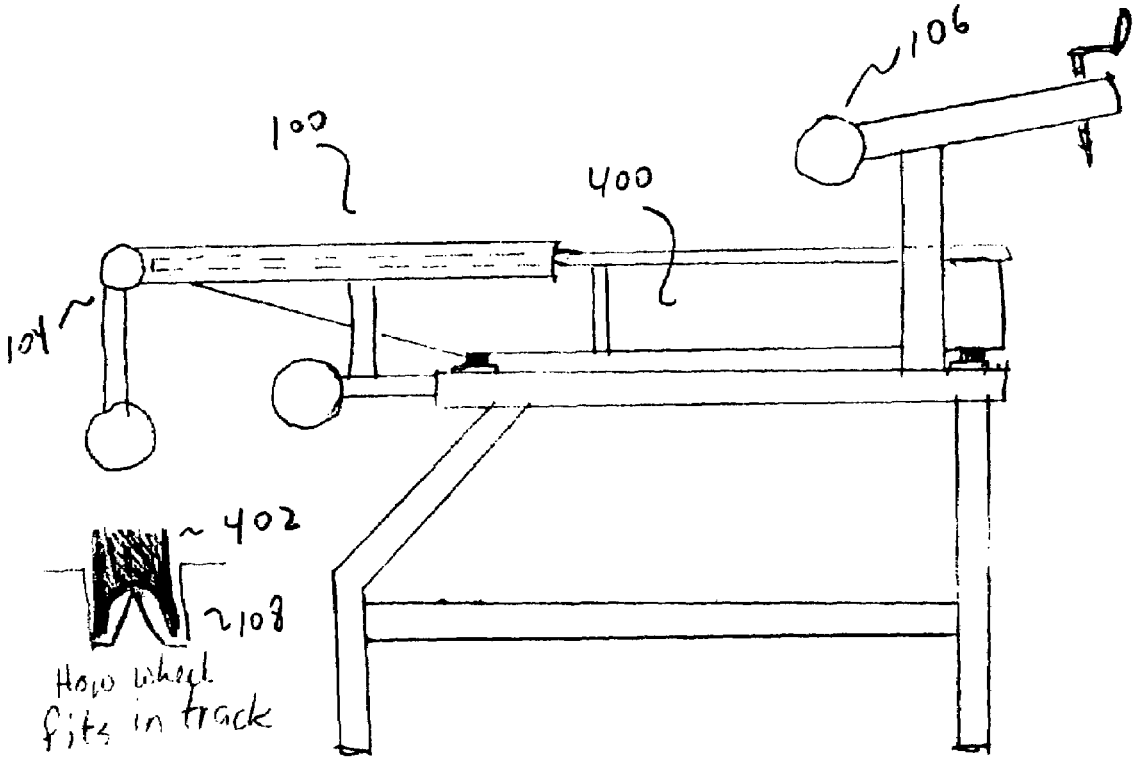
FIG. 5 is a side view of a stencil table mounted on a quilt frame.

FIG. 5 shows a side view of the stencil table 400 mounted on a quilting frame 100. Wheels 402 are mounted in grooves 108 to allow the stencil table to move on support platform 102 as dictated by the shape and alignment of grooves 108. By way of non-limiting example, the GAMMILL quilting system uses "U" shaped wheels that ride on a metal internal "V" shaped track. Stencil table 402 will use these tracks 108, such that wheels 402 would have the corresponding "V" shape and be spaced apart so as to fit smoothly into the grooves 108.

The height of stencil table 400 is such that its top 404 lies just below the horizontal plane defined by the quilt path from roller 104 to roller 106 (when in the lower position). The top of stencil table 402 will provide a firm surface beneath quilt 120 to mark quilting lines with the pounce method.

There is preferably a small gap between the top of stencil table 402 and a quilt extending from roller 104 and 106. The gap allows (1) for stencil table 400 to move without contacting quilt 120, and (2) a modest amount of quilt deflection so that the three quilt layers are pressed together when chalk is applied. The gap is preferably less than 1.5" inches to avoid undue stress on the material, particularly less than or equal to 1.0", and most particularly approximately 0.5".

A front end of stencil table 400 extends just short of abutting contact with roller 104, providing the maximum lateral surface area to support quilt 120. This front end preferably comes within two inches of the closest point of roller 104, and particularly within one inch.

Since quilt 120 does not extend rearward beyond roller 106, the back end of stencil table 400 need not extend rearward beyond roller 106. Optionally stencil table 400 can extend beyond roller 106, either in whole in part (e.g., a projection or handle 502) to provide a gripping surface to manipulate the position of stencil table 400.

Stencil table 400 is preferably 12" wide, which is the most common large sized stencil block used in quilts. If a larger stencil is used, stencil table 400 can be rolled under the extended area with little effort. The stencil can be realigned before the extended area is pounced. Of course, the invention is not so limited, and any width may be used.

Once the quilt is pounced, stencil table 400 can be moved out of the way or removed from the table entirely. Longarm quilting machine 300 is then mounted on grooves 108 in support platform 102, and the quilter sews quilt 120 according the quilting lines laid out by the chalk. Chalk applied during pouncing with stencil table 400 will hold better to the material during high-speed machine sewing, and thus provide a more distinct line for the quilt maker to follow. The finished quilting motif has a greater chance for symmetry and accuracy, thus enhancing its overall quality and value.

Figure 4:
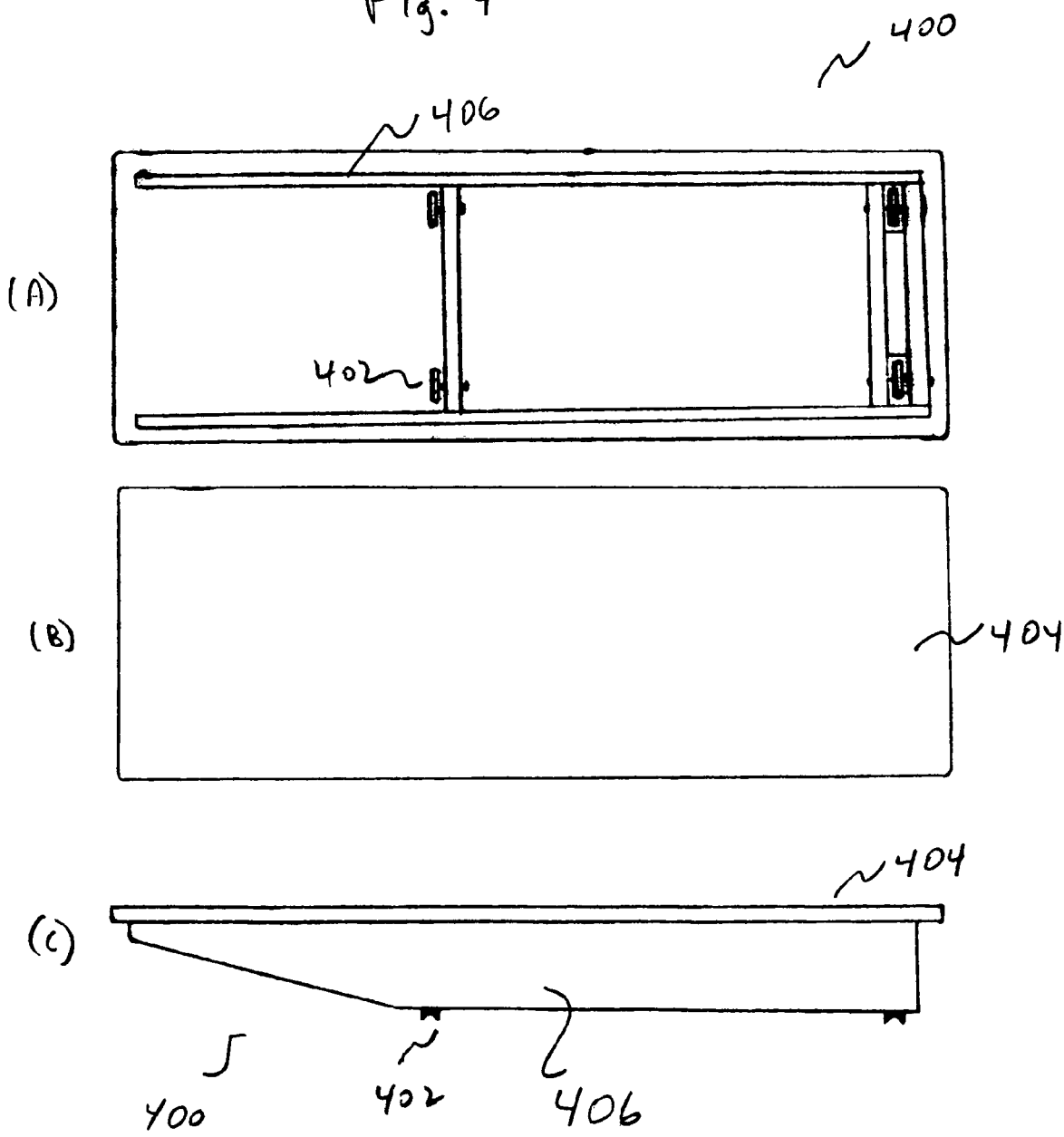
FIGS. 4A-4C are bottom, top, and side views of an embodiment of a stencil table, respectively.

The following preferable measurements are for a stencil table 400 for the embodiment of FIG. 4 that fits a GAMMILL quilting system. It is constructed from wood ¾ inch thick. The top 404 of stencil table 400 is 45 inches by 16 inches. The height from top 404 to grooves 108 is 5¼ inches. Frame 406 measures 14½ by 26⅝ inches, and supports four wheels 402. Wheels 402 are set 25¼ inches apart to roll on the longarm table track as set by grooves 108. The sides of the box extend to within ¾ inch of the front of the tabletop. The wheels are attached 1¼ inch up from the bottom edge of the wheel to the center axle (one inch up from the bottom of the box). The wheels are set in 3 inches in from the side of the box, and run parallel to the back of the box. The wheels are exposed ½ inch. There is a second piece of wood mounted behind the back wheels.

Figure 6:
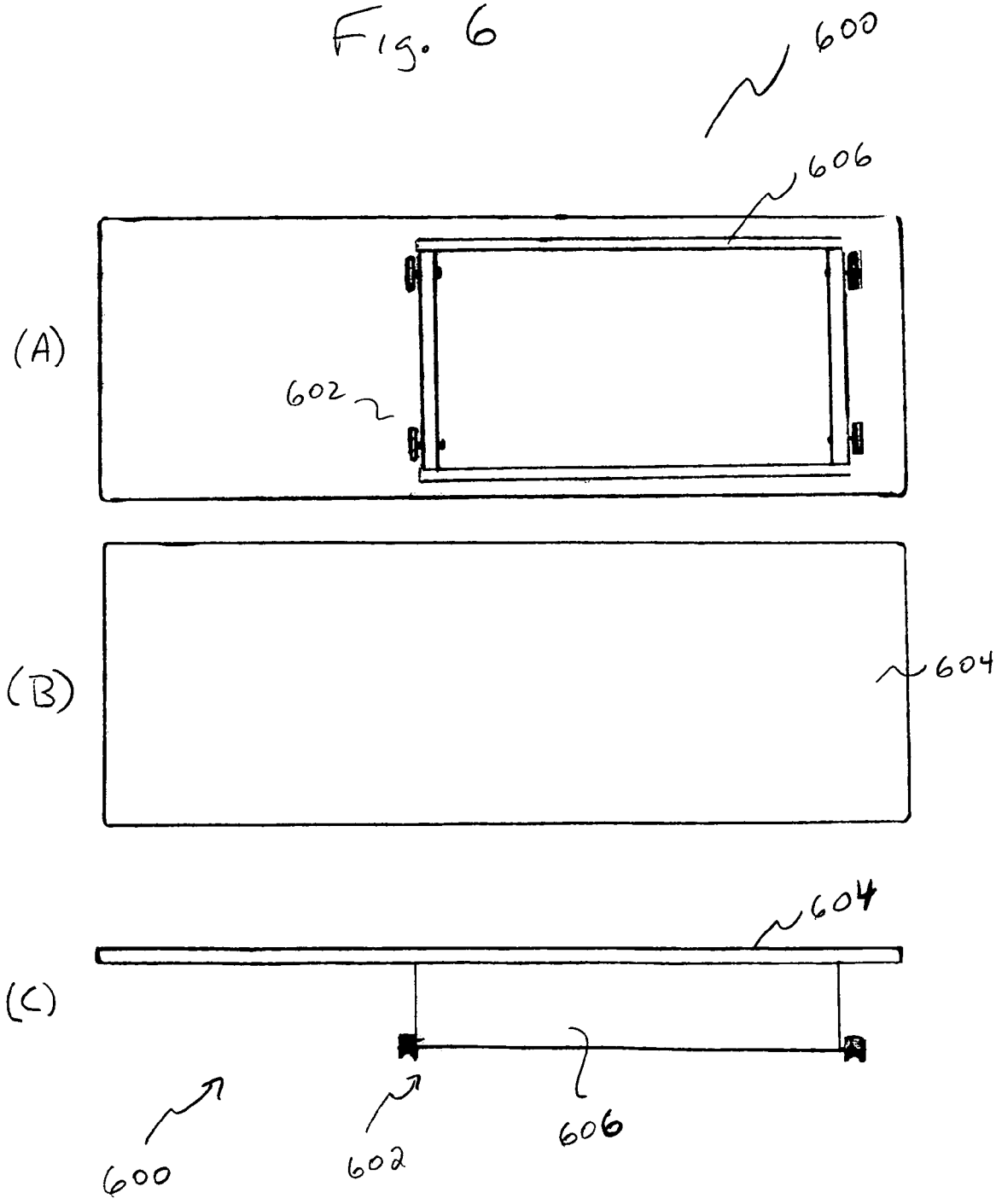
FIGS. 6A-6C are bottom, top, and side views of another embodiment of a stencil table, respectively.

Another embodiment of a stencil table 600 for use with the present invention is shown in FIGS. 6A-6C. It includes a top 604, an intermediate supporting box frame 606, and a bottom with a plurality of wheels 602. Top 604 and frame 606 are preferably made from wood ¾ inches thick. Of course, other materials and thicknesses could be used provided it was strong enough to provide support but light enough to be easily moved.

The following measurements are for a stencil table 600 that fits a GAMMILL quilting system. It is constructed from wood ¾ inch thick. The top 604 of stencil table 600 is 42.5 inches by 13 inches. The height from top 604 to grooves 108 is 4.75 inches. Frame 606 measures 10½ by 25 inches, and supports four wheels 602. Wheels 602 are set 25 inches apart to roll on the long arm table track as set by grooves 108. The wheels are attached 1¼ inch up from the bottom edge of the wheel to the center axle (½ inch up from the bottom of the box). The wheels are set in 1½ inches in from the side of the box, and run parallel to the back of the box. The wheels extend ½ inch below the bottom of the box.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A system for supporting a quilt to lay quilting lines, comprising:

a frame configured to support a sewing machine;

first and second rollers mounted on said frame, and configured to hold quilting layers on a substantially horizontal path between said first and second rollers;

a platform mounted on said frame, said platform having tracks, a top of said platform being below said substantially horizontal path;

a moveable support table, independent from any sewing machine, mounted on said tracks; and a top of said moveable support table being less than approximately 1½ inches below said substantially horizontal path;

wherein said moveable support table supports a quilt during the application of quilting lines thereto, said quilting lines defining visual paths to follow for subsequent sewing.

2. The system of claim 1, wherein a forward end of said moveable table support extends to within one inch of said first roller.

3. The system of claim 1, wherein said moveable support table comprises:

a top surface;

a frame beneath said top surface; and a plurality of wheels connected to said frame and mounted in said tracks.

4. The system of claim 3, wherein said tracks have a substantially inverted "V" shaped projection, and said plurality of wheels have a substantially inverted "U" shaped recess.

5. The system of claim 4, wherein the plurality of wheels define an area, said area being offset from a center of said top.

6. The system of claim 1, further comprising a hand grip extending from the moveable platform.

7. The system of claim 3, wherein the plurality of wheels are one enclosed by said frame or outside of said frame.

8. The system of claim 1, wherein said top of said moveable support table is approximately 1 inch below said substantially horizontal path.

9. The system of claim 1, wherein said top of said moveable support table is at least approximately ½ inch below said substantially horizontal path.

10. A moveable support table configured to for use with a longarm quilting machine, the quilting machine including a frame, members configured to define a horizontal path, a platform having spaced apart tracks below said substantially horizontal path, said moveable support table comprising:

a top surface independent of any sewing machine;

a frame connected to and beneath said top surface;

a plurality of wheels connected to said frame, said wheels being distributed into a plurality of rows spaced apart a distance that corresponds to a distance of said spaced apart tracks;

said wheels defining an area, said area being offset from a center of said top;

wherein when said plurality of wheels are mounted in said tracks, a top of said moveable support table is less than approximately one inch below said substantially horizontal path.

11. The system of claim 10, wherein said plurality of wheels have a substantially inverted "U" shaped recess.

12. The system of claim 10, further comprising a hand grip extending from the moveable platform.

13. The system of claim 10, wherein the plurality of wheels are one enclosed by said frame or outside of said frame.

14. A system for supporting a quilt to lay quilting lines, comprising:

a frame configured to support a sewing machine;

first and second rollers mounted on said frame, and configured to hold quilting layers on a substantially horizontal path between said first and second rollers;

a platform mounted on said frame, said platform having tracks, a top of said platform being below said substantially horizontal path;

a moveable support table mounted on said tracks; and a top of said moveable support table being less than approximately 1 ½ inches below said substantially horizontal path;

wherein said moveable support table supports a quilt during the application of quilting lines thereto;

wherein said top has a longitudinal axis, and said plurality of wheels only allow said table to move at an angle to said longitudinal axis.

15. A moveable support table configured to for use with a longarm quilting machine, the quilting machine including a frame, members configured to define a horizontal path, a platform having spaced apart tracks below said substantially horizontal path, said moveable support table comprising:

a top surface;

a frame connected to and beneath said top surface;

a plurality of wheels connected to said frame, said wheels being distributed into a plurality of rows spaced apart a distance that corresponds to a distance of said spaced apart tracks; and said wheels defining an area, said area being offset from a center of said top;

wherein when said plurality of wheels are mounted in said tracks, a top of said moveable support table is less than approximately one inch below said substantially horizontal path;

wherein said top has a longitudinal axis, and said plurality of wheels only allow said table to move at an angle to said longitudinal axis.

* * * * *